United States Patent [19]

Schexnayder

[11] 4,055,046

[45] Oct. 25, 1977

[54] CONTROL SYSTEM HAVING OVERRIDE FOR FLUID OPERATED WORK ELEMENTS

[75] Inventor: Lawrence F. Schexnayder, Joliet, Ill.

[73] Assignee: Caterpillar Tractor Co., Peoria, Ill.

[21] Appl. No.: 753,251

[22] Filed: Dec. 22, 1976

[51] Int. Cl.[2] ..... F15B 13/06; F15B 13/09

[52] U.S. Cl. ..... 60/428; 60/445; 60/486

[58] Field of Search ..... 60/428, 430, 445, 486; 417/286, 426

[56] References Cited

U.S. PATENT DOCUMENTS

| | | | |
|---|---|---|---|
| 3,841,795 | 10/1974 | Ferre et al. | 60/486 X |
| 3,963,378 | 6/1976 | McMillan | 60/428 X |

*Primary Examiner*—Edgar W. Geoghegan
*Attorney, Agent, or Firm*—Frank L. Hart

[57] ABSTRACT

A control system has override for fluid operated work elements served by at least two variable displacement pumps each serving a separate circuit. At least two work elements are served by the first circuit and at least one work element is served by the second circuit. The discharge rate of the first pump is controlled by a signal delivered from a summing valve in response to the pressures of the first and second circuits during operation of a preselected one of the work elements of the first circuit and controlled by a modified pilot pressure signal in response to operation of only the other work element of the first circuit.

6 Claims, 1 Drawing Figure

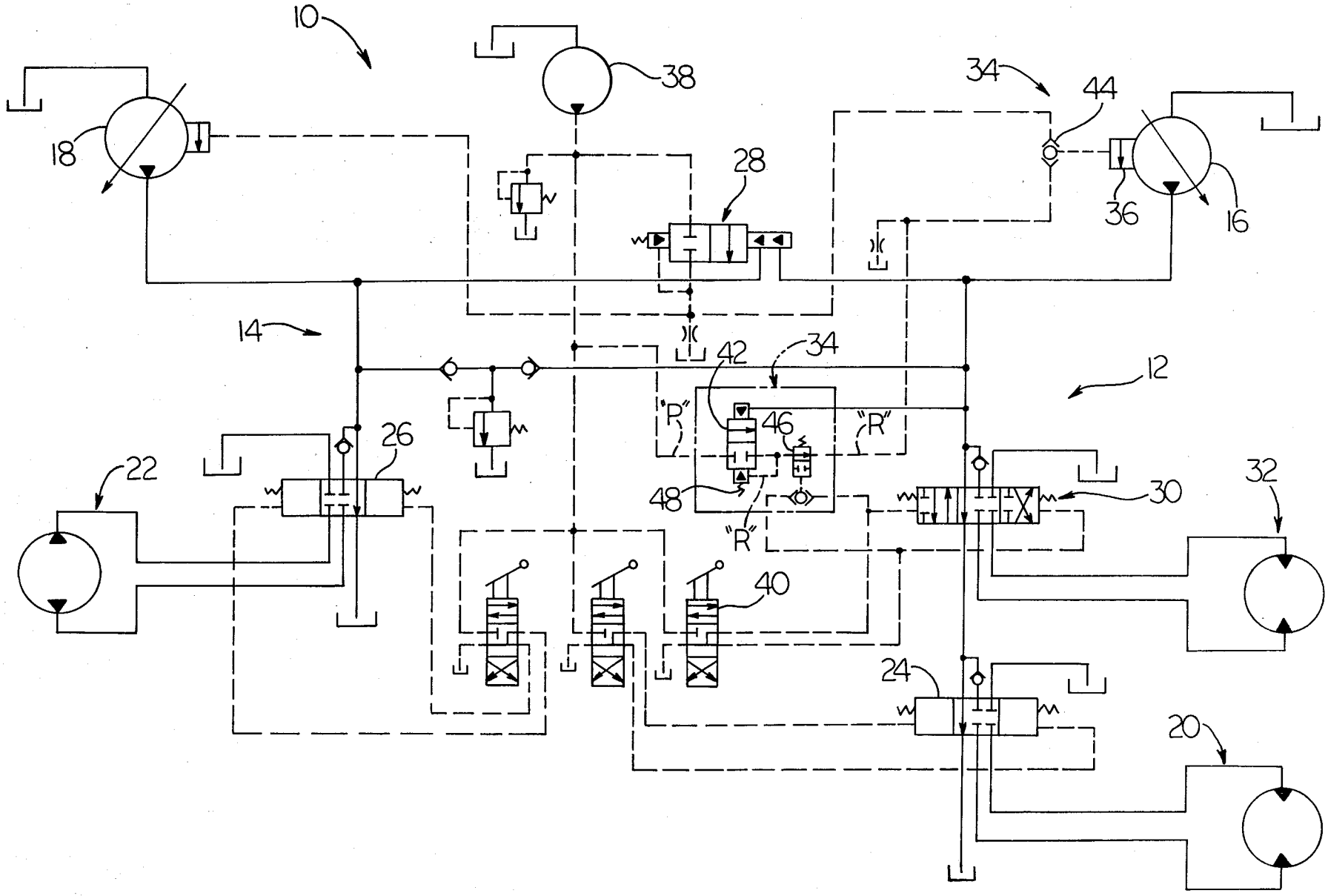
10
12
14
16
18
20
22
24
26
28
30
32
34
36
38
40
42
44
46
48
"R"
"R"
"R"

CONTROL SYSTEM HAVING OVERRIDE FOR FLUID OPERATED WORK ELEMENTS

BACKGROUND OF THE INVENTION

In fluid control systems, for example a hydraulic system of an excavator, there are often a plurality of pumps serving a plurality of hydraulic circuits each of which supply fluid to one or more work elements. The pressure and fluid rate requirements of the different work elements often vary markedly between the elements.

In order to prevent waste of labor and materials, it is therefore desirable to solve the problem of providing a control system which will function to control the pump of a fluid circuit in response to the operational mode of the work elements served by the particular circuit. By so constructing the control system, work elements of widely varying maximum pressure construction can be served by a single fluid circuit.

The present invention is directed to overcoming the problems as set forth above.

In accordance with this invention, a fluid system has first and second circuits each having a variable displacement pump serving first and second work elements through respective first and second directional control valves. The first and second pumps are associated with a summing valve for controlling the rate of discharge of the pumps. A first means is provided for controlling the output of one of the pumps of a selected circuit in response to a signal delivered from the summing valve during operation of the work elements of both of the circuits and for controlling the output of said one of the pumps by a modified pilot pressure signal in response to the operation of only the work element of the selected one of the circuits having said one of the pumps.

BRIEF DESCRIPTION OF THE DRAWINGS

The drawing is a diagrammatic view of a portion of the fluid system of a work vehicle having the control apparatus of this invention.

DETAILED DESCRIPTION OF THE INVENTION

Referring to the drawing, a fluid system 10, for example a hydraulic system of an excavator, has first and second circuits 12,14. Each of the circuits 12,14 has respective first and second variable displacement pumps 16,18 serving respective first and second work elements 20,22 through respective first and second directional control valves 24,26. A summing valve 28 is in communication with the discharge of each pump 16,18, and is of a construction sufficient for delivering a control signal to the pumps 16,18 responsive to the summation of the discharge pressures for controlling the discharge rate of said pumps 16,18. The first circuit 12 has additionally a third directional control valve 30 that is connected to a third work element 32. The first and third directional control valves 24,30 are connected in interruptable series.

For example purposes, the first work element 20 is boom swing apparatus, the second work element 22 is right track apparatus, the third work element 32 is left track apparatus. It should be understood, however, that the work elements 20,22,32 can be for other apparatus, there can be additional work elements in each circuit, and there can be additional circuits each served by a separate pump.

In this invention, first means 34 is provided for controlling the fluid output from the first pump 16 only in response to a signal delivered from the summing valve 28 during the operational mode where the first circuit 12 has the third work element 32 being utilized. In an operational mode where the first circuit 12 has only the first work element 20 utilized, the first pump 16 is controlled by a modified pilot pressure signal from the first means 34.

In the preferred construction of the control apparatus of this invention, the first variable displacement pump 16 has an actuator 36 for varying the fluid output of the pump. The first means 34 comprises a pilot pump 38, second means 40 for controlling the operation of the third directional control valve 30, a compensating valve 42, and the actuator 36.

The compensating valve 42 is of a construction sufficient for modifying a pressure signal "P" from the pilot pump 38 in response to the discharge pressure of the first pump 16 and the position of the third directional control valve 30 and delivering a resultant modified pressure signal "R" to the actuator 36 of the first pump 16.

The compensating valve 42 is connected to the discharge of the first pump 16, the actuator 36, and the pilot pump 38 by hydraulic conduits as are well known in the art. The blocker valve 46 is a normally open valve and is connected to the second means 40 for closing blocker valve 46 in response to actuating element 40 for utilizing the third work element 32.

The first means 34 preferably has third means 44, for example a resolving valve, for controlling the discharge of the first pump 16 in response to the larger of the signal "S" from the summing valve and the resultant signal "R" from the compensating valve 42. The resolving valve 44 is connected to the summing valve 28, actuator 36, and compensating valve 42 by hydraulic conduits.

A blocker valve is connected to the compensating valve 42 and the second means 40 and is of a construction sufficient for interrupting the resultant modified pressure signal "R" during operation of the third work element 32 and for passing said signal "R" from the compensating valve 42 to the third means 44 in response to said first circuit 12 having only the first work element 20 in operation.

In the preferred construction of the compensating valve, the pilot pump signal "P" is modified in response to the discharge pressure of the first pump 16 as opposed by a mechanical biasing element 48 such as a spring and the resultant modified pilot pressure signal "R".

In the preferred embodiment as set forth above, the switching between control by summing and control by composition is in response to operation or nonoperation of the third work element. It should be understood that the mode of controlling can be selected in response to a signal responsive to the actuation of the first or second work elements.

In the operation of the example system, so long as the third work element 32 is being utilized, the output of the first pump 16 is being controlled by signal "S" from the summing valve 28. When the third work element 32 is not being utilized, the output of the first pump is being controlled by signal "R" from the compensating valve 42.

By this construction, the first work element 20 is protected from excessively high flows that might be delivered in response to a summing signal which is responsive to the fluid demands from other circuits. Further, the power requirements can be reduced by this construction which more accurately controls fluid demands.

The embodiments of the invention in which an exclusive property or privilege is claimed are defined as follows:

1. In a fluid system having first and second circuits each having a variable displacement pump serving respective first and second work elements through respective first and second directional control valves and being associated with a summing valve for controlling said pumps, the improvement comprising:

first means for controlling the output from the pump of one of the first or second circuits in response to a signal delivered from the summing valve during operation of the work elements of both circuits and for controlling the output of the said pump by a modified pilot pressure signal in response to the operation of only the work element of the selected one of the first or second circuits.

2. In a fluid system having first and second circuits each having a variable displacement pump serving respective first and second work elements through respective first and second directional control valves and being associated with a summing valve for controlling said pumps, said first circuit having a third directional control valve connected to a third work element and being connected in interruptible series with said first directional control valve, the improvement comprising:

first means for controlling the output from the first pump in response to a signal delivered from the summing valve during operation of the third element and for controlling the output of the first pump by a modified pilot pressure signal in response to said first circuit having only the first work element in operation.

3. A hydraulic system, as set forth in claim 2, wherein the first variable displacement pump has an actuator for varying the fluid output thereof and wherein the first means comprises:

a pilot pump;

second means for controlling the operation of the third directional control valve;

a compensating valve connected to the discharge of the first pump,, the actuator of the first pump, the second means and the pilot pump, and being of a construction sufficient for modifying a pressure signal from the pilot pump in response to the discharge pressure of the first pump and the position of the third directional control valve and delivering a resultant modified pressure signal to the actuator of the first pump.

4. A hydraulic system, as set forth in claim 3, wherein the first means includes:

third means for controlling the discharge of the first pump in response to the larger of the signal from the summing valve and the resultant signal from the compensating valve.

5. A hydraulic system, as set forth in claim 4, including:

a blocker valve connected to the compensating valve and the second means, and being of a construction sufficient for interrupting the resultant modified pressure signal from the compensating valve during operation of the third work element and for passing said resultant modified pressure signal from the compensating valve to the third means in response to said first circuit having only the first work element in operation.

6. A hydraulic system, as set forth in claim 3, wherein the compensating valve is of a construction sufficient for modifying a pressure signal from the pilot pump in response to the discharge pressure of the first pump as opposed by a mechanical biasing element and the resultant modified pilot pump signal.

* * * * *